US007048042B2

(12) United States Patent
Juschka

(10) Patent No.: US 7,048,042 B2
(45) Date of Patent: May 23, 2006

(54) HEAT EXCHANGER, IN PARTICULAR EXHAUST GAS HEAT EXCHANGER FOR MOTOR VEHICLES, AND METHOD FOR PRODUCING SAME

(75) Inventor: Winfried Juschka, Stuttgart (DE)

(73) Assignee: BEHR GmgH & Co. KG, Stuttgart (DE)

( * ) Notice: Subject to any disclaimer, the term of this patent is extended or adjusted under 35 U.S.C. 154(b) by 0 days.

(21) Appl. No.: 11/033,451

(22) Filed: Jan. 12, 2005

(65) Prior Publication Data

US 2005/0167091 A1 Aug. 4, 2005

(30) Foreign Application Priority Data

Jan. 12, 2004 (DE) ..... 10 2004 001 787

(51) Int. Cl.
*F28F 9/04* (2006.01)

(52) U.S. Cl. ..... 165/173

(58) Field of Classification Search ..... None
See application file for complete search history.

(56) References Cited

U.S. PATENT DOCUMENTS

| | | | | |
|---|---|---|---|---|
| 2,228,549 | A * | 1/1941 | Young | 165/133 |
| 4,526,077 | A * | 7/1985 | DeGuvera | 83/686 |
| 4,738,308 | A * | 4/1988 | Moranne | 165/149 |
| 4,848,645 | A * | 7/1989 | Franzolini et al. | 228/183 |
| 4,881,594 | A | 11/1989 | Beamer et al. | |
| 4,948,177 | A * | 8/1990 | Dalo et al. | 285/122.1 |
| 5,036,913 | A * | 8/1991 | Murphy et al. | 165/173 |
| 5,044,244 | A * | 9/1991 | Olson | 83/686 |
| 5,295,532 | A * | 3/1994 | Hughes | 165/76 |
| 5,445,219 | A * | 8/1995 | Hutto et al. | 165/173 |
| 5,749,414 | A * | 5/1998 | Damsohn et al. | 165/178 |
| 6,269,870 | B1 | 8/2001 | Banzhaf et al. | |
| 6,330,747 | B1 * | 12/2001 | Lambert et al. | 29/898.052 |
| 6,749,015 | B1 * | 6/2004 | Moreau | 165/174 |
| 2002/0162651 | A1 | 11/2002 | Nakagome et al. | |
| 2004/0182547 | A1 | 9/2004 | Birkert et al. | |

FOREIGN PATENT DOCUMENTS

| | | |
|---|---|---|
| CH | 416 697 | 7/1966 |
| DE | 199 07 163 A1 | 10/1999 |
| DE | 102 04 107 A1 | 9/2003 |
| DE | 102 24 263 A1 | 12/2003 |
| EP | 1 154 143 A1 | 11/2001 |
| GB | 622421 | 5/1949 |
| GB | 974 590 | 11/1962 |
| JP | 11-159993 A | 6/1999 |

* cited by examiner

*Primary Examiner*—Allen J. Flanigan
(74) *Attorney, Agent, or Firm*—Foley & Lardner LLP

(57) ABSTRACT

A heat exchanger, in particular an exhaust gas heat exchanger for motor vehicles, has a bundle of tubes through which hot gas flows, a pair of header plates and a housing jacket, which holds the bundle of tubes and the header plates and through which a liquid cooling medium flows. The header plates have openings (8) for receiving tube ends (3*a*) which are welded to the header plates (2), which are in turn welded to the housing jacket. The header plates (2, 7) are constructed from a plurality of layers of metal sheets which are layered one above another and are fixedly connected together.

12 Claims, 1 Drawing Sheet

Fig. 1
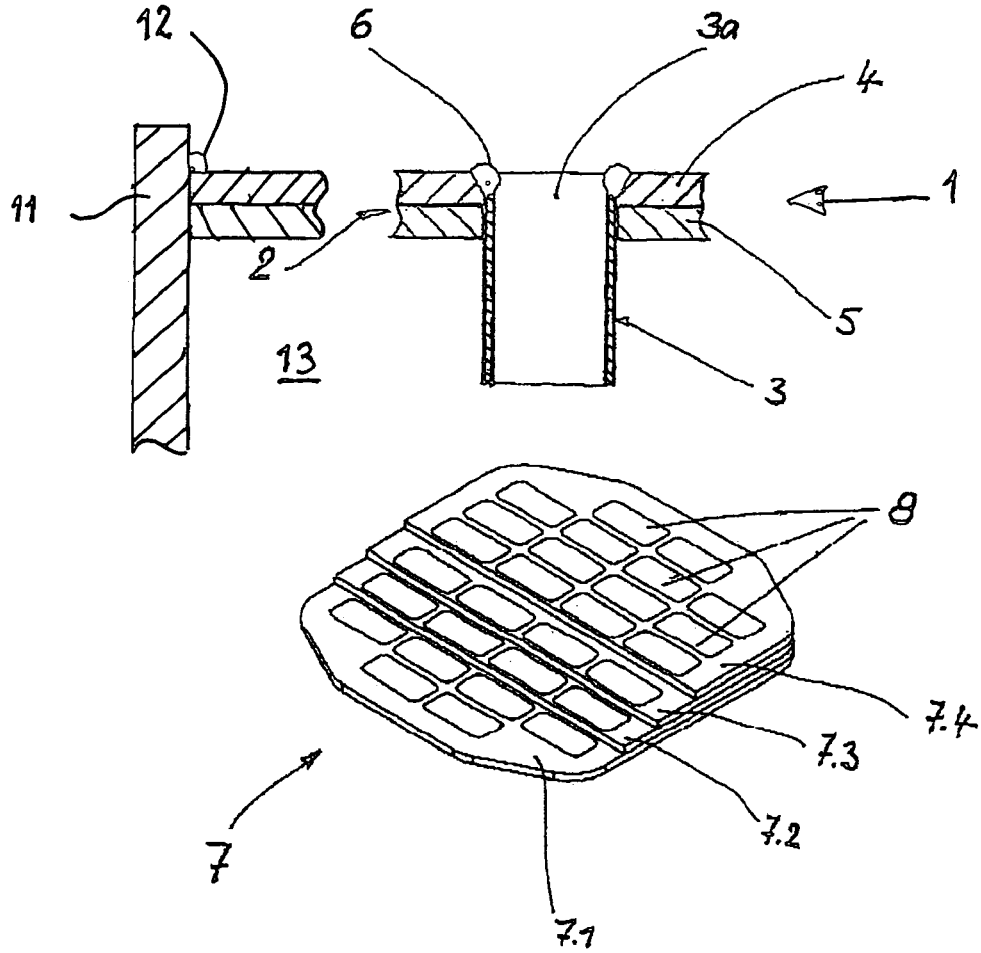
Fig. 2
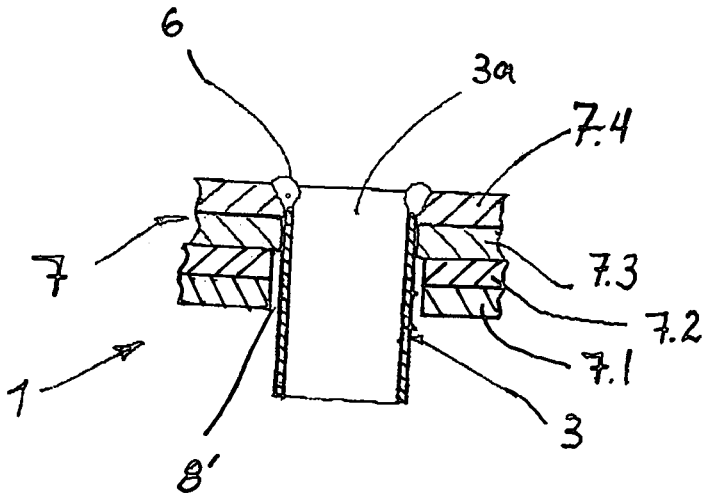
Fig. 3

HEAT EXCHANGER, IN PARTICULAR EXHAUST GAS HEAT EXCHANGER FOR MOTOR VEHICLES, AND METHOD FOR PRODUCING SAME

CROSS-REFERENCE TO RELATED PATENT APPLICATIONS

The right of foreign priority under 35 U.S.C. § 119(a) is claimed based on Federal Republic of Germany Application No. 10 2004 001 787.5, filed Jan. 12, 2004, the entire contents of which, including the specification, drawings, claims and abstract, are incorporated herein by reference.

BACKGROUND OF THE INVENTION

The invention relates to a heat exchanger, in particular an exhaust gas heat exchanger for motor vehicles.

DE-A 199 07 163 discloses a heat exchanger, in particular an exhaust gas heat exchanger for motor vehicles, which can be used in the exhaust gas recirculation (EGR) system as an exhaust gas cooler. The known exhaust gas heat exchanger is a welded stainless steel construction and has a housing jacket, a bundle of tubes with exhaust tubes and tube plates or header plates. The tubes are welded by their tube ends into punched-out openings in the header plates, and the header plates, for their part, are welded to the housing jacket. Hot exhaust gas flows through the tubes, and a liquid cooling medium, i.e., a coolant which is removed from the coolant circuit of the motor vehicle, flows around the tubes and within a jacket space inside of the housing jacket. The known exhaust gas cooler is intermittently subjected to hot exhaust gases, depending on whether an exhaust gas recirculation valve in an exhaust gas recirculation line is open or closed. The tubes assume the temperature of the hot exhaust gases while the housing jacket assumes the coolant temperature, which is substantially lower than the exhaust gas temperature. The above-mentioned welded connections between the tubes, header plates and housing jacket mean that the tubes are clamped on both sides fixedly in the housing jacket, i.e., the system is statically undetermined. The alternating action of the temperature on the exhaust gas tubes results in different expansions between the exhaust gas tubes and housing jacket, i.e., the tubes expand to a greater extent than the housing jacket and therefore cause thermal stresses, in particular in the region of the connections between the tubes and header plates. Added to this is the fact that the header plates bulge, i.e., are elastically deformed, because of the tube expansions, which means that the tubes are subject to a bending stress. Due to the manufacturing process, the header plates only have a maximum thickness of the order of magnitude of 1 to 2 mm, because the hole punching procedure employed to produce the openings causes problems in thicker header plates. The alternating bending stress on the tubes results in fatigue of the tube material in the region of the header plates and sometimes produces cracks in the tubes.

SUMMARY OF THE INVENTION

Accordingly, it is one object of the present invention to provide an improved exhaust gas heat exchanger.

It is another object of the present invention to provide suitable constructive measures in a heat exchanger of the type mentioned at the beginning that avoid or at least reduce harmful stresses, in particular a bending stress on the tubes.

In accordance with one aspect of the present invention, there has been provided a heat exchanger, suitable for use as an exhaust gas heat exchanger for a motor vehicle comprising: a plurality of tubes suitable for conducting a hot gas, the plurality of tubes forming a bundle of tubes comprising individual tubes which are arranged spaced apart and have tube ends; and at least one header plate having openings for receiving the tube ends. The tube ends are connected to the at least one header and the at least one header plate comprises a plurality of layers of individual metal sheets which are layered one above another and are fixedly connected to one another.

In accordance with another aspect of the invention, there has been provided a method for producing a heat exchanger having a plurality of tubes suitable for conducting a hot gas, the plurality of tubes forming a bundle of tubes comprising individual tubes which are arranged spaced apart and have tube ends; and at least one header plate having openings for receiving the tube ends, wherein the tube ends are connected to the at least one header plate. The method comprises: punching, in each metal sheet individually, the plurality of openings for receiving the tube ends of the plurality of tubes, in an array corresponding to the tube bundle; layering the plurality of metal sheets upon one another so that corresponding openings of the array in each sheet are aligned; fixedly connecting the layered metal sheets together to form the at least one header plate; and connecting the tube ends in the header plate openings.

Further objects, features and advantages of the present invention will become apparent from the detailed description of preferred embodiments that follows, when considered together with the accompanying figures of drawing.

BRIEF DESCRIPTION OF THE DRAWINGS

FIG. 1 is a cross-sectional view showing a portion of a heat exchanger including a tube/plate connection;

FIG. 2 is a perspective view showing one preferred embodiment of a tube plate according to the invention, referred to as a "laminate plate"; and FIG. 3 is a cross-sectional view similar to FIG. 1, showing the tube plate of FIG. 2 used in a tube/plate connection.

DETAILED DESCRIPTION OF PREFERRED EMBODIMENTS

The present invention provides a header plate constructed from a plurality of layers, i.e., a plurality of metal sheets, which are fixedly connected to one another, advantageously by welding or brazing. This provides a relatively thick plate, a "laminate plate," which is flexurally rigid in relation to the stresses which occur, i.e., it no longer bulges under the pressure produced by expansion of the tubes. The tubes are therefore no longer subject to any bending stress, but rather only to a controllable pressure loading. The stress on the heat exchanger is therefore considerably reduced and, therefore, so too is the risk of material damage. At the same time, the advantage is gained of being able to produce the laminate plate by means of a punching (hole punching) procedure in which the layers are punched individually. Therefore, each layer has a maximum sheet-metal thickness which readily permits the punching of the openings for receiving the tube ends. A "punchable" thick header plate is therefore obtained, with relatively low production costs. For example, layers are preferably selected having a sheet-metal thickness of approximately 1.5 mm, in which the required tube matrix can be produced in one working step by hole punching. A plurality of these identical layers, preferably 2 to 4, are then layered one above another, thus resulting in an overall thickness of the header plate of 3 to 6 mm. For manufacturing reasons, it is advantageous, under some circumstances, if one or more of the layers have differently sized holes, e.g., the lower layer(s) may have somewhat larger holes, in order to facilitate introduction of the tubes. Since the metal sheets are welded or brazed to one another, they maintain the flexural rigidity of a solid header plate having the same thickness.

Turning now to the drawings, FIG. 1 shows an individual tube/plate connection 1 between a header plate 2 and an exhaust gas tube 3. The header plate 2 comprises two layers, an upper layer 4 and a lower layer 5, which are fixedly connected to one another in a such manner that they cannot slide in relation to one another. The exhaust gas tube 3 (only part of which is illustrated) has a tube end 3*a* which preferably ends flush with the upper layer 4 and is connected fixedly and tightly all around its circumference to the upper layer 4, preferably by means of a laser weld seam 6. This tube/plate connection 1 is part of an exhaust gas heat exchanger of the general type described in DE-A 199 07 163, cited above, the entire contents of which are incorporated herein by reference. The exhaust gas heat exchanger according to the invention can be used in particular for exhaust gas recirculation systems in motor vehicles, i.e., the tubes 3 have hot exhaust gases from the internal combustion engine flowing through them and are cooled on the outside by the coolant used in the engine coolant circuit. The tubes and header plates preferably are comprised of stainless steel.

FIG. 2 shows a perspective illustration of a preferred header plate 7 according to the invention, i.e. a "laminate plate," which is constructed from four layers 7.1, 7.2, 7.3, 7.4. All of the four layers 7.1 to 7.4 are identical, i.e., they have the same contour and the same pattern, or tube matrix, of holes 8. In some embodiments the corresponding holes formed in each respective plate are of the same size, whereas in other embodiments it may be advantageous to have one or more of the registering holes in the respective plates of a different size. For example, one or more of the lower layers 7.1, 7.2 etc., may have somewhat larger holes 8, such as the holes 8' illustrated in FIG. 3 in the layers 7.1 and 7.2.

Each individual layer has a sheet-metal thickness that is less than or equal to about 1.5 mm and preferably has a thickness of approximately 1.5 mm, in which case the entire tube plate 7 has a thickness of about 6 mm. The tube matrix comprised of holes 8 is produced individually for each individual layer 7.1, 7.2, 7.3, 7.4 by hole punching. The maximum sheet-metal thickness that permits punching without problems or limitations is therefore not exceeded by this chosen thickness.

All of the layers preferably consist of stainless steel, are layered one on another after the punching and are preferably welded to one another, e.g., by resistance welding or cold welding. A virtually solid header plate 7 having high flexural rigidity is therefore provided.

The tubes 3 described in FIG. 1 are inserted into the tube matrix 8 of the header plate 7 and are welded on the end side. The laminate plate 7 is inserted together with the bundle of tubes into a housing jacket 11 in a manner which is conventional and thus is not illustrated in detail and is welded circumferentially to the housing jacket to form welds 12. This produces a fixed connection between the tubes 3 and the housing jacket 11 and forms a jacket space 13 for transport of a cooling liquid in heat exchange relationship with the tubes 3 and the hot gas flowing inside the tubes.

If there is a thermally induced difference in expansion between the tubes and housing jacket, the tubes 3 deposit their thrust onto the header plate 2 or 7, which is held by the housing. The header plate 2 or 7, however, is not deformed, i.e., does not bulge under this loading, with the result that the tubes maintain their rectilinear orientation and are not bent. A bending stress on the tubes therefore is essentially prevented.

FIG. 1 shows, by way of example, a header plate having two layers; FIG. 2 depicts a header plate having four layers. Of course, the number and thickness of the individual layers can be changed and matched to the particular stress. By contrast, a tube plate according to FIG. 2, i.e., having a thickness of approximately 6 mm and the tube matrix illustrated would not be able to be produced from a thick metal sheet by punching. Rather, a more costly manufacturing method would have to be selected to produce such a single-layered header plate of this thickness, for example, erosion or milling.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heat exchanger, suitable for use as an exhaust gas heat exchanger for a motor vehicle comprising:

a plurality of tubes suitable for conducting a hot gas;

the plurality of tubes forming a bundle of tubes comprising individual tubes which are arranged spaced apart and have tube ends; and at least one header plate having openings for receiving the tube ends, wherein the tube ends are connected to the at least one header plate and wherein the at least one header plate comprises a plurality of layers of individual metal sheets which are layered one above another and are fixedly connected to one another, wherein the individual metal sheets comprise a plurality of identical metal sheets, wherein the openings for receiving the tube ends comprise punched openings, and wherein the corresponding openings in at least a first one of the plurality of metal sheets are of a size different from those in at least a second one of the plurality of metal sheets.

2. A heat exchanger according to claim 1, wherein the thickness of the individual metal sheets is such that the at least one header plate is flexurally rigid.

3. A heat exchanger according to claim 1, wherein the openings in said first metal sheet are smaller than the openings in said second metal sheet and wherein said first metal sheet is closer to the distal ends of the tubes than the second metal sheet.

4. A heat exchanger according to claim 1, wherein each metal sheet has a thickness that is sufficiently thin to permit punching of the openings in a single punching step.

5. A heat exchanger according to claim 1, wherein the at least one header plate comprises a plurality of metal sheets, each sheet having a thickness of $\leqq 1.5$ mm.

6. A heat exchanger according to claim 5, wherein the at least one header plate comprises two to four layers of said metal sheets.

7. A heat exchanger according to claim 1, wherein the plurality of metal sheets are welded to one another.

8. A heat exchanger according to claim 1 further comprising a housing member within which the at least one header plate is mounted.

9. A heat exchanger according to claim 8, wherein the at least one header plate is welded in the housing member.

10. A heat exchanger according to claim 1, wherein the at least one header plate comprises two of said header plates, with respective header plates being connected to opposite ends of the tubes.

11. A method for producing a heat exchanger having a plurality of tubes suitable for conducting a hot gas, the plurality of tubes forming a bundle of tubes comprising individual tubes which are arranged spaced apart and have tube ends; and at least one header plate having openings for receiving the tube ends, wherein the tube ends are connected to the at least one header plate, the method comprising:

punching, in each metal sheet individually, the plurality of openings for receiving the tube ends of the plurality of tubes, in an array corresponding to the tube bundle, wherein in at least one first metal sheet the openings have a first size and in at least one second metal sheet the openings have a second size larger than said first opening size;

layering the plurality of metal sheets, including said first and second metal sheets, upon one another so that corresponding openings of the array in each sheet are aligned;

fixedly connecting the layered metal sheets together to form the at least one header plate; and connecting the tube ends in the header plate openings.

12. A heat exchanger according to claim 3, wherein the header plate comprises four of said metal sheets, wherein the two metal sheets adjacent the ends of the tubes have the configuration of said first metal sheets and wherein the two metal sheets layered in the header plate on the side facing away from the tube ends have the configuration of said second metal sheets.

* * * * *